US005507686A

United States Patent [19]

Wolters

[11] Patent Number: 5,507,686

[45] Date of Patent: Apr. 16, 1996

[54] BRAKE-DISK GRINDING

[75] Inventor: Martin Wolters, Wupertal, Germany

[73] Assignee: Ernst Thielenhaus KG, Wuppertal, Germany

[21] Appl. No.: 290,670

[22] Filed: Aug. 15, 1994

[30] Foreign Application Priority Data

Aug. 28, 1993 [DE] Germany ..... 43 28 987.8

[51] Int. Cl.[6] ..... B24B 7/19

[52] U.S. Cl. ..... 451/63; 451/435

[58] Field of Search ..... 451/342, 63, 435, 451/290, 285, 521, 508, 510

[56] References Cited

U.S. PATENT DOCUMENTS

| | | | |
|---|---|---|---|
| 2,993,311 | 7/1961 | West . | |
| 3,136,100 | 7/1962 | Robertson, Jr. | 451/510 |
| 3,456,399 | 7/1969 | Bonin . | |
| 3,456,401 | 7/1969 | Kushmuk . | |
| 3,716,951 | 2/1973 | Walters | 451/342 |
| 3,912,411 | 10/1975 | Moffat | 451/342 |
| 4,285,167 | 8/1981 | Roth | 451/342 |
| 4,306,383 | 12/1981 | Gress | 451/342 |
| 4,361,988 | 12/1982 | Gramlich | 451/63 |
| 4,766,702 | 8/1988 | Kinner | 451/63 |
| 5,031,363 | 7/1991 | Thiem | 451/63 |
| 5,040,338 | 8/1991 | Schwär | 451/290 |
| 5,056,266 | 10/1991 | Norris | 451/290 |

*Primary Examiner*—Bruce M. Kisliuk
*Assistant Examiner*—Derris Banks
*Attorney, Agent, or Firm*—Herbert Dubno; Andrew Wilford

[57] ABSTRACT

An apparatus for grinding a metallic workpiece rotating about and centered on an axis and having an annular surface also centered on the workpiece axis has a tool support radially offset from the workpiece axis, continuously rotating about a support axis radially offset from and substantially parallel to the workpiece axis, and having an forwardly axially directed front support face, and an annular grinding tool engaging the workpiece surface, centered on a respective tool axis, and having an axially backwardly directed rear tool face. The tool face is resiliently supported on the support face annularly all around the support and tool axes so that the tool axis can rock relative to the support axis.

4 Claims, 2 Drawing Sheets

BRAKE-DISK GRINDING

FIELD OF THE INVENTION

The present invention relates to a method of and apparatus for grinding a generally planar annular face of a metallic workpiece. More particularly this invention concerns the grinding of a disk-brake disk.

BACKGROUND OF THE INVENTION

A brake disk has an annular rim projecting radially outward from a cylindrical cup-shaped hub and having a pair of axially opposite annular faces that lie in respective parallel planes perpendicular to the symmetry axis of the disk. Such a disk is cast of metal and is given its finished shape by rotating it about its axis on a lathe-like machine that cuts the critical hub and rim faces. Since this material-removing roughing operation scores the rim faces, such a roughed workpiece must subsequently be finished by grinding at least its rim faces.

The standard procedure for finish grinding is to clamp the hub of the roughed disk and rotate the disk about its axis while urging a grinding stone axially against each rim face. Although such a procedure should in theory produce a perfectly planar finish in the brake disk, in reality the results are less than satisfactory. Invariably the rotation axis of the disk moves a little, for instance due to worn bearings supporting the disk-holding chuck, so that the resultant surface can be somewhat wavy and nonplanar.

As described in U.S. Pat. No. 4,456,401 of Kushmuk it is known to grind the faces of a metallic workpiece, in particular of a brake disk, by rotating the disk about its axis and urging against each of its faces a grinding stone that in turn is rotated about an axis at least generally parallel to the disk-rotation axis. According to this patent the grinding stone is rotated about an axis that is parallel to the disk axis, but it is mounted on a universal joint so that it can rock somewhat with respect to its rotation axis and thereby follow the surface being ground. A spring braced across the joint urges the grinding disk into a position centered on an axis parallel to that of the disk, while permitting the above-mentioned rocking.

More specifically in the Kushmuk patent the grinding stone has a sleeve-like hub that fits over a grinding-tool drive shaft that rotates about its own axis that extends parallel to the disk axis. This hub has a ring with a universal-joint formation that engages the back of the grinding tool. The tool itself has two diametrally opposite pins extending orthogonal to the grinding-tool axis and that are engaged in slots in the sleeve-like hub. In this manner during grinding the spring presses the grinding tool against the disk face while the pins rotationally entrain the tool. The pins, however, inhibit the desired swiveling action of the universal-joint formations so that the resultant finish is not completely satisfactory. The loose fit can lead to uncontrolled vibration that produces a wavy finish in the brake disk.

OBJECTS OF THE INVENTION

It is therefore an object of the present invention to provide an improved grinding method and apparatus.

Another object is the provision of such an improved grinding method and apparatus which overcomes the above-given disadvantages, that is which can produce a smooth and flat finish on a roughed brake disk.

SUMMARY OF THE INVENTION

An apparatus for grinding a metallic workpiece rotating about and centered on an axis and having an annular surface also centered on the workpiece axis has a tool support radially offset from the workpiece axis, continuously rotating about a support axis radially offset from and substantially parallel to the workpiece axis, and having an forwardly axially directed front support face, and an annular grinding tool engaging the workpiece surface, centered on a respective tool axis, and having an axially backwardly directed rear tool face. According to the invention the tool face is resiliently supported on the support face annularly all around the support and tool axes so that the tool axis can rock relative to the support axis.

More specifically, the annular grinding tool has an annular axially forwardly directed grinding surface engaging the workpiece surface, an axially forwardly directed front tool face, and an axially backwardly directed rear tool face axially confronting the front support face and formed with an axially backwardly open recess radially spacedly receiving a centering formation projecting axially forward from the center of the support face. The support is rotated about the support axis with the grinding surface engaging the workpiece surface and projecting radially outwardly past the workpiece surface. An elastically compressible ring is directly engaged between the rear tool face and front support face and surrounds the formation and recess. In addition, an elastically compressible body is directly engaged against the front tool face. Structure secured in the formation presses the body axially backward against the front tool face and thereby compresses the ring between the rear tool face and front support face for limited rocking of the tool axis relative to the support axis.

Thus the instant invention works without a universal joint. The invention is based on the surprising discovery that it is possible to finish grind something and produce an extremely smooth surface when the grinding stone is held in a simple elastically deformable mount, not in by a complex mechanical joint. The tool surface can deflect in any direction to follow the surface it is smoothing and thus automatically produces a fine finish, without adding any irregularities to the workpiece surface. The tool is not constrained in any direction, as is the case when it is mounted by a knuckle-type or universal joint. In fact a frustoconical surface can easily be finish machined with the system of this invention.

According to a further feature of this invention the tool is cup-shaped and open forward toward the workpiece. The pressing structure includes a flat rigid disk bearing axially backward against the body and a bolt threaded in the projection and having a head bearing axially backward on the disk. The tool surface can be annularly continuous or annularly discontinuous and formed with abrasive-free gaps. The ring can be a flat elastomeric washer and the body a flat elastomeric disk.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
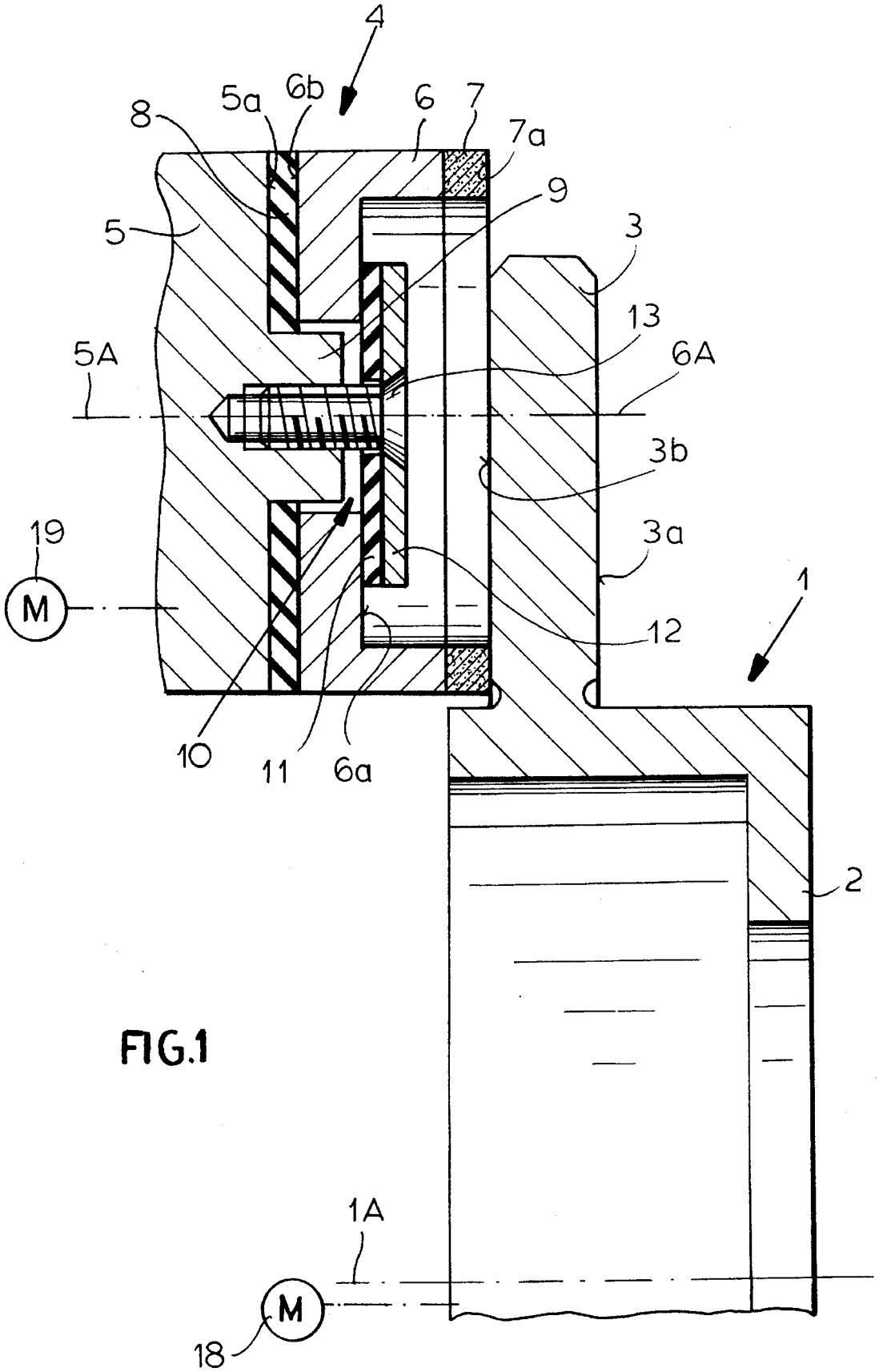
FIG. 1 is a partly diagrammatic axial section through an apparatus according to the invention.

As seen in FIG. 1 a brake-disk assembly 1 having a hub 2 and a disk or rim 3 and centered on an axis 1A is continuously rotated about this axis 1A by a drive indicated schematically at 18. The disk 3 has axially oppositely directed planar annular surfaces 3*a* and 3*b* of which the rear surface 3*b* is being finish ground in FIG. 1.

A grinding or tool assembly 4 comprises a drive or support shaft 5 centered on a support axis 5A and a grinding stone or tool 6 having a ring 7 of grinding material and centered on an axis 6A normally coaxial with the axis 5A, as illustrated. The support shaft 5 is rotated about the axis 5A by a drive illustrated schematically at 19 and has a planar and annular front face 5*a* from which a central bump or projection 9 extends axially forwardly centered on the axis 5A. The tool 6 has an axially backwardly directed planar face 6*b* confronting the face 5*a* and is centrally formed with a cylindrical hole or recess 10 in which the bump 9 is received with radial play.

A flat and annular washer 8 of elastomeric material is engaged between the surfaces 5*a* and 6*b*. A flat disk or washer 12 compresses another disk or washer 11 of elastomeric material against a front face 6*a* of the tool 6 to push it axially back and thereby compress the washer 8. A screw 13 centered on the axis 5A fixes the disk 12 with respect to the support shaft 5 and serves to hold the disk 12 in place.

The tool assembly 4, or at least an annularly continuous front surface 7*a* of the grinding ring 7, is of a diameter that is greater than the radial dimension of the surface 3*b*. Thus the tool 4 projects radially outward past the outer periphery of the face 3*b* to produce some self-sharpening action. During grinding the face 7*a* can rock somewhat, taking the axis 5A into a position nonparallel to the axis 6A. In this manner the grinding tool 4 will follow the surface it is grinding and make it perfectly smooth.

Figure 2:
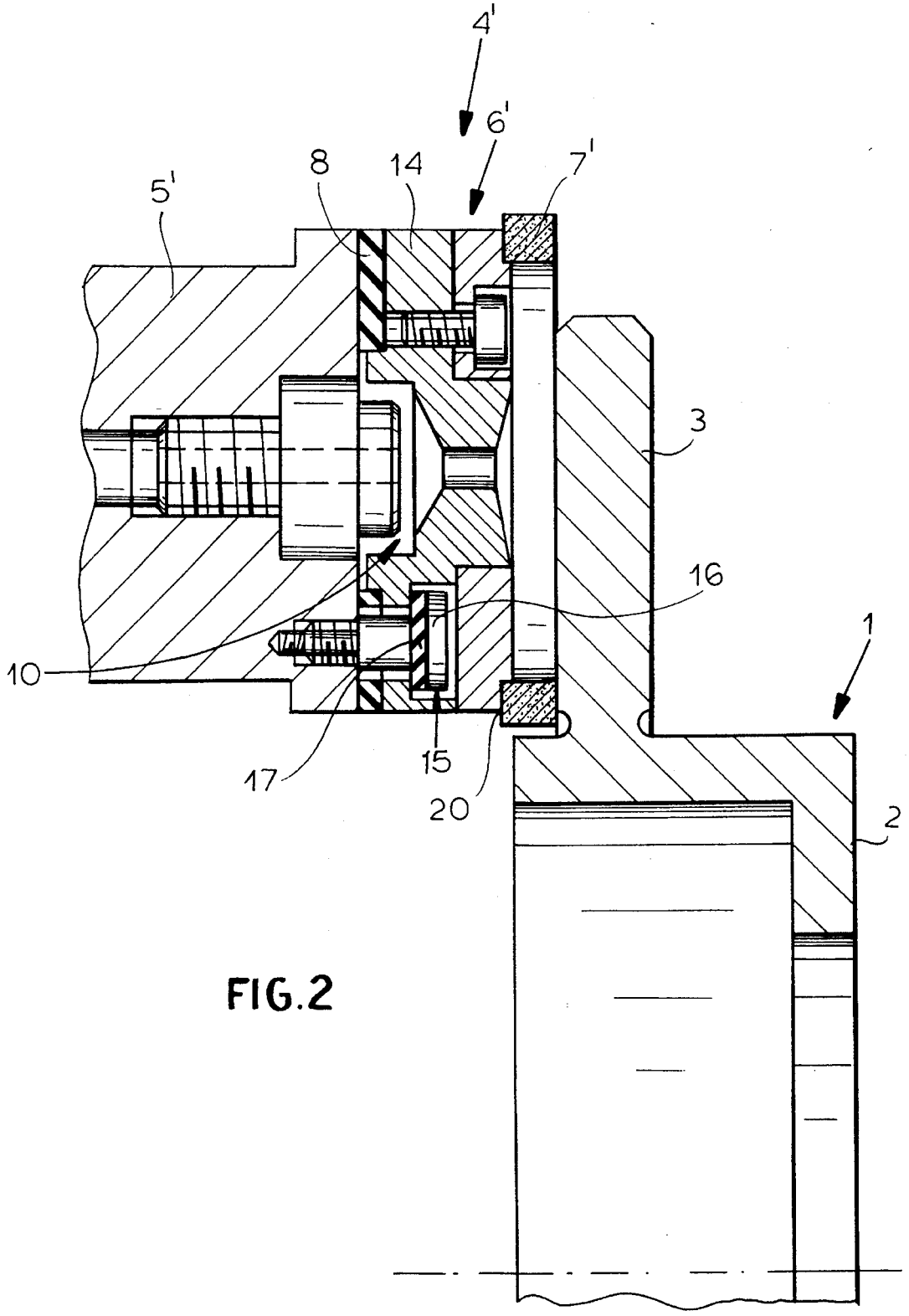
FIG. 2 is a view like FIG. 1 of another apparatus in accordance with this invention.

FIG. 2 shows a similar arrangement where reference numerals from FIG. 1 are used for identical structure and reference numerals from FIG. 1 but provided with primes (') are used for functionally identical structure. One difference here is that the grinding ring 7' is discontinuous, being formed with gaps 20, In addition here instead of a single central screw 13, there are three angularly equispaced screws 15 having heads 16 bearing by respective elastomeric washers 17 on a body 14 of the tool 4'. This tool 5' can also rock with respect to the support shaft 5'.

I claim:

1. An apparatus for grinding a metallic workpiece centered on and rotating about an axis and having an annular surface also centered on the axis and lying substantially in a plane perpendicular to the axis, the apparatus comprising:

a tool support radially offset from the workpiece axis, rotatable about a support axis radially offset from and substantially parallel to the workpiece axis, and having a forwardly axially directed front support face formed at the support axis with an axially forwardly projecting centering formation;

an annular cup-shaped grinding tool centered on a tool axis, open toward the workpiece, and having an annular axially forwardly directed grinding surface engaging the workpiece surface, an axially forwardly directed front tool face, and an axially backwardly directed rear tool face axially confronting the front support face and formed with an axially backwardly open recess radially spacedly receiving the centering formation;

means for rotating the support about the support axis with the grinding surface engaging the workpiece surface and projecting radially outwardly past the workpiece surface;

an elastically compressible flat elastomeric washer directly engaged between the rear tool face and front support face and surrounding the formation and recess;

an elastically compressible flat elastomeric disk directly engaged against the front tool face; and means including a flat rigid disk bearing axially backward on the flat elastomeric disk and secured in the formation for pressing the flat elastomeric disk axially backward against the front tool face and thereby compressing the flat elastomeric washer between the rear tool face and front support face for limited rocking of the tool axis relative to the support axis.

2. The grinding apparatus defined in claim 1 wherein the pressing means includes a bolt threaded in the projection and having a head bearing axially backward on the flat rigid disk.

3. The grinding apparatus defined in claim 1 wherein the tool surface is annularly continuous.

4. The grinding apparatus defined in claim 1 wherein the tool surface is annularly discontinuous and formed with abrasive-free gaps.

* * * * *